US009037010B2

(12) United States Patent
Naganawa

(10) Patent No.: US 9,037,010 B2
(45) Date of Patent: May 19, 2015

(54) HEATING DEVICE AND IMAGE FORMING APPARATUS INCLUDING ERROR PROCESSING

(71) Applicant: Brother Kogyo Kabushiki Kaisha, Nagoya-shi, Aichi-ken (JP)

(72) Inventor: Hiroyuki Naganawa, Nagoya (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 13/624,408

(22) Filed: Sep. 21, 2012

(65) Prior Publication Data

US 2013/0136467 A1 May 30, 2013

(30) Foreign Application Priority Data

Nov. 30, 2011 (JP) ..... 2011-261736

(51) Int. Cl.
*G03G 15/00* (2006.01)
*G03G 15/20* (2006.01)

(52) U.S. Cl.
CPC ..... *G03G 15/55* (2013.01); *G03G 15/2039* (2013.01); *G03G 15/5004* (2013.01); *G03G 15/5087* (2013.01)
USPC ..... 399/37; 399/67; 399/69

(58) Field of Classification Search
USPC ..... 399/37, 67, 69; 219/216
See application file for complete search history.

(56) References Cited

U.S. PATENT DOCUMENTS

| | | | | |
|---|---|---|---|---|
| 7,310,486 | B2 * | 12/2007 | Kawazu et al. | 399/69 |
| 2006/0093388 | A1 | 5/2006 | Kawazu et al. | |
| 2011/0052217 | A1 | 3/2011 | Mochizuki | |
| 2011/0123208 | A1 | 5/2011 | Inukai | |
| 2011/0274456 | A1 * | 11/2011 | Higashi et al. | 399/88 |

FOREIGN PATENT DOCUMENTS

| | | | |
|---|---|---|---|
| CN | 102004425 | A | 4/2011 |
| JP | 2000-298414 | A | 10/2000 |
| JP | 2004-139008 | A | 5/2004 |
| JP | 2008-065033 | A | 3/2008 |
| JP | 2011-113807 | A | 6/2011 |

OTHER PUBLICATIONS

Office Action issued in related Chinese Patent Application No. 201210352578.4, mailed Dec. 23, 2014.
Office Action issued in related Japanese Appl. No. 2011-261736, mailed Mar. 3, 2015.

* cited by examiner

*Primary Examiner* — G. M. Hyder
(74) *Attorney, Agent, or Firm* — Merchant & Gould PC

(57) ABSTRACT

A heating device including: a heat generating unit configured to receive an AC voltage from a power supply; a zero-crossing signal generating unit configured to generate a zero-crossing signal which is a square pulse signal synchronizing with a zero-crossing timing of the AC voltage, the zero-crossing signal being a first level at the zero-crossing timing and being a second level at other timings; and a control device configured to perform a detecting process in which an abnormality in a frequency or an output wave of the power supply or is detected, and an error processing, in a case where the abnormality in the frequency of the power supply or the abnormality in the output waveform of the power supply is detected and the level of a zero-crossing signal at a detection timing of detecting the abnormality is the second level.

6 Claims, 8 Drawing Sheets

HEATING DEVICE AND IMAGE FORMING APPARATUS INCLUDING ERROR PROCESSING

CROSS-REFERENCE TO RELATED APPLICATIONS

This application claims priority from Japanese Patent Application No. 2011-261736 filed on Nov. 30, 2011, the entire contents of which are incorporated herein by reference.

TECHNICAL FIELD

Aspects of the present invention relate to a heating device and an image forming apparatus having the heating device.

BACKGROUND

JP-A-2011-113807 discloses a technology for detecting an abnormality in a power supply of a heating device and performing error processing. Specifically, in a case where the width of a zero-crossing signal is a predetermined time period or less, it is determined that a rectangular wave is being input to a fixing heater and supply of electric power to the fixing heater is interrupted.

Recently, due to electric power saving, after an AC power supply is turned off, a voltage of a power supply circuit tends to drop more gradually than before. In this case, even after the AC power supply is turned off, an operation time of a control device such as an ASIC for detecting an abnormality in a power supply of a heating device becomes longer. Therefore, there is a fear that a state where the AC power supply is in an OFF state and an AC voltage is not input may be erroneously determined as an abnormality in the power supply, and the error processing will be performed even in a case where the AC power supply is merely in the OFF state.

SUMMARY

The present invention was made based on the above-mentioned circumferences, and an object of the present invention is to improve the accuracy of detection of abnormalities in a power supply and to appropriately perform error processing.

According to an aspect of the present invention, there is provided a heating device including: a heat generating unit configured to generate heat in response to receiving an AC voltage from a power supply; a zero-crossing signal generating unit configured to generate a zero-crossing signal which is a square pulse signal synchronizing with a zero-crossing timing of the AC voltage supplied from the power supply and received by the heat generating unit, the zero-crossing signal being a first level at the zero-crossing timing and being a second level at other timings; and a control device configured to perform a detecting process in which an abnormality in a frequency of the power supply or an abnormality in an output waveform of the power supply is detected, and an error processing, in a case where the abnormality in the frequency of the power supply or the abnormality in the output waveform of the power supply is detected and the level of a zero-crossing signal at a detection timing of detecting the abnormality is the second level.

According to another aspect of the present invention, there is provided a heating device including: a heat generating unit configured to generate heat in response to receiving an AC voltage from a power supply; a zero-crossing signal generating unit configured to generate a zero-crossing signal which is a square pulse signal synchronizing with a zero-crossing timing of the AC voltage supplied from the power supply and received by the heat generating unit, the zero-crossing signal being a first level at the zero-crossing timing and being a second level at other timings; and a control device configured to obtain a period of the zero-cross signal, determine a first abnormality if the obtained period does not satisfy a first condition, obtain a pulse width of the zero-cross-signal, when the first abnormality is not determined, determine a second abnormality if the obtained pulse width does not satisfy a second condition, and perform error processing when the first abnormality is determined and the level of a zero-crossing signal at a detection timing of determining the first abnormality is the second level or when the second abnormality is determined and the level of a zero-crossing signal at the detection timing of determining the second abnormality is the second level.

Accordingly, in a case where the level of the zero-crossing signal is the second level, error processing is performed. Therefore, when the power supply is in the OFF state such that the level of the zero-crossing signal is the first level, the error processing is not erroneously performed.

The above-described heating device can also be used in an image forming apparatus so as to fix a toner image formed by an image forming unit to a recording medium.

According to the present invention, it is possible to improve the accuracy of detection of abnormalities in a power supply and to appropriately perform error processing.

DETAILED DESCRIPTION

<First Exemplary Embodiment>

A first exemplary embodiment of the present invention will be described with reference to FIGS. 1 to 8.

(1-1) Configuration of Printer

Figure 1:
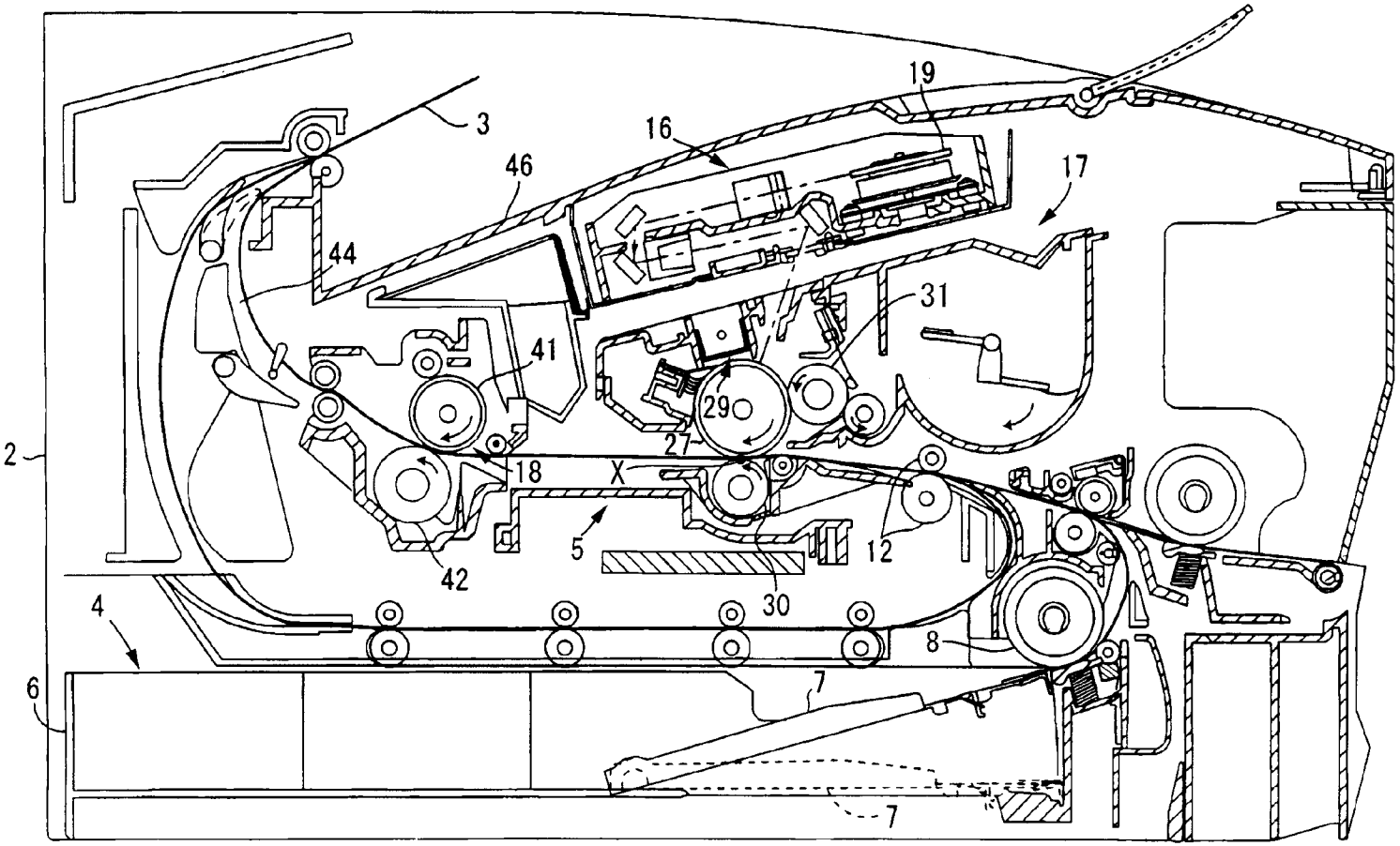
FIG. 1 is a sectional side view illustrating a main portion of an image forming apparatus according to a first exemplary embodiment of the present invention.

FIG. 1 is a sectional side view illustrating a main portion of a laser printer 1 (an example of an image forming apparatus). The laser printer 1 (hereinafter, referred to as a printer) includes a main body frame 2, a paper feeding unit 4, an image forming unit 5, a fixing unit 18, etc.

The paper feeding unit 4 includes a paper tray 6 for loading printing sheets 3 (an example of a recording medium), a pressing plate 7, and a paper feeding roller 8. The pressing plate 7 is rotatable on its rear end portion, and presses the printing sheets 3 on the pressing plate 7 toward the paper feeding roller 8. If the paper feeding roller 8 rotates, the printing sheets 3 are sent to a conveyance path, one by one.

A fed printing sheet 3 is registered by registration rollers 12 and is sent to a transfer position X. The transfer position X is a position where a toner image on a photosensitive drum 27 is transferred onto the printing sheet 3, and is the contact position of the photosensitive drum 27 and a transfer roller 30.

The image forming unit 5 forms a toner image on the printing sheet 3, and includes a scanner unit 16, a processing cartridge 17, and so on. The scanner unit 16 includes a laser-beam emitting unit (not shown), a polygon mirror 19, and so on. A laser beam (an alternate long and short dash line in FIG. 1) emitted from the laser-beam emitting unit is deflected by the polygon mirror 19 and is irradiated onto the surface of the photosensitive drum 27.

The processing cartridge 17 includes a developing roller 31, the photosensitive drum 27, and a scorotron charger 29. The charger 29 uniformly and positively charges the surface of the photosensitive drum 27. The positively charged surface of the photosensitive drum 27 is exposed by the laser beam emitted from the scanner unit 16 such that an electrostatic latent image is formed. Next, toner carried on the surface of the developing roller 31 is fed to the electrostatic latent image formed on the photosensitive drum 27 such that the electrostatic latent image is developed.

The fixing unit 18 includes a heating roller 41, a pressing roller 42, a heating device 43 (see FIG. 3), and so on. The fixing unit 18 thermally fixes the toner image to the printing sheet 3 while the printing sheet 3 passes between the heating roller 41 and the pressing roller 42. The printing sheet 3 having the toner thermally fixed thereon is discharged onto a discharge tray 46 through a discharge path 44.

(1-2) Electrical Configuration of Printer

Figure 2:
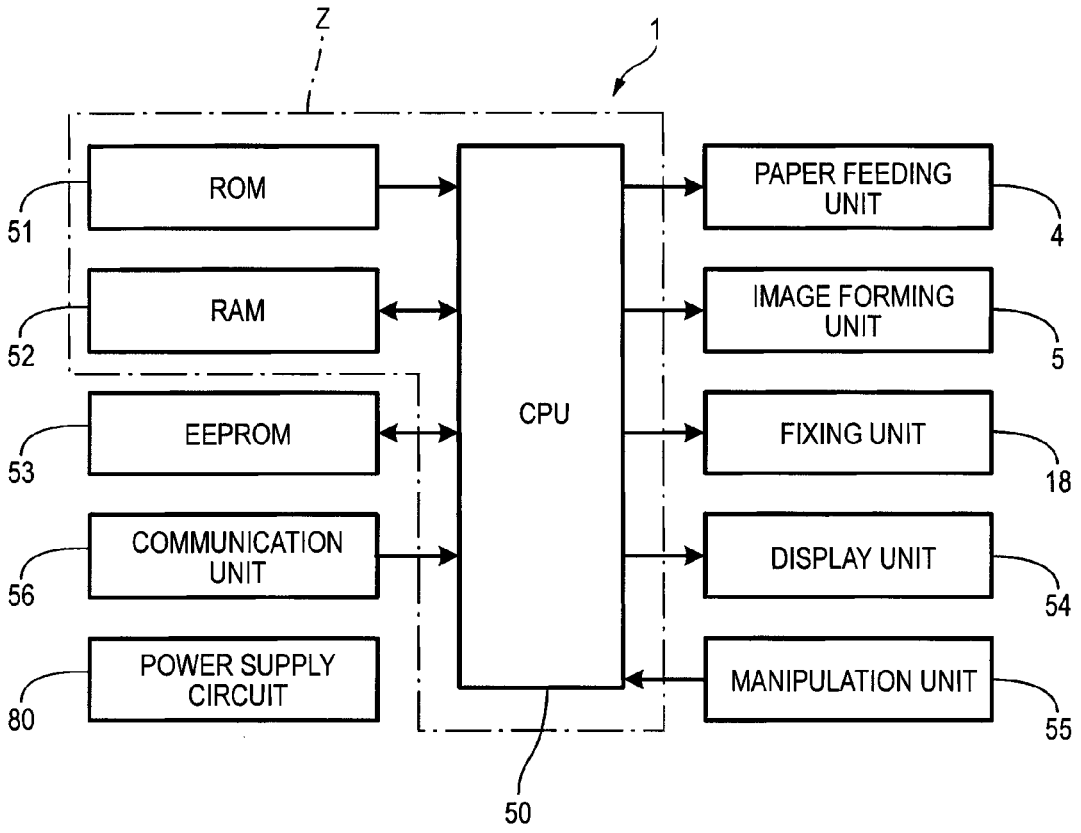
FIG. 2 is a block diagram illustrating the image forming apparatus.

FIG. 2 is a block diagram illustrating an electrical configuration of the printer 1.

The printer 1 includes a Central Processing Unit (CPU) 50, a Read-Only Memory (ROM) 51, a Random Access Memory (RAM) 52, an Electrically Erasable and Programmable Read-Only Memory (EEPROM) 53, the paper feeding unit 4, the image forming unit 5, the fixing unit 18, a display unit 54, a manipulation unit 55, a power supply circuit 80, a communication unit 56 for data communication with an information terminal device, etc.

The CPU 50 executes various programs stored in the ROM 51, thereby controlling each unit of the printer 1, etc. In the present exemplary embodiment, among a plurality of control functions of the CPU 50, a function of controlling the heating device 43 will be described later in detail.

The ROM 51 stores various programs to be executed by the CPU 50, data which the CPU 50 will refer to for various processes, etc. The RAM 52 is used as a main storage device for performing various processes. The EEPROM 53 is a non-volatile memory capable of storing information even if supply of electric power stops, and stores various option information.

The display unit 54 includes various lamps, a liquid crystal panel, and so on. The manipulation unit 55 is configured by an input panel, etc., and a user can manipulate the manipulation unit 55 while referring to the display unit 54, thereby instructing printing or other operations.

In addition, the printer 1 includes a network interface (not shown) for connection with an external device, and the like, such that the user can use the external device to instruct the printer to perform printing through the network interface. Also, the CPU 50, the RAM 52, and the ROM 51 configure a control unit Z, which corresponds to a control device of the present invention.

(1-3) Configuration of Heating Device

Figure 3:
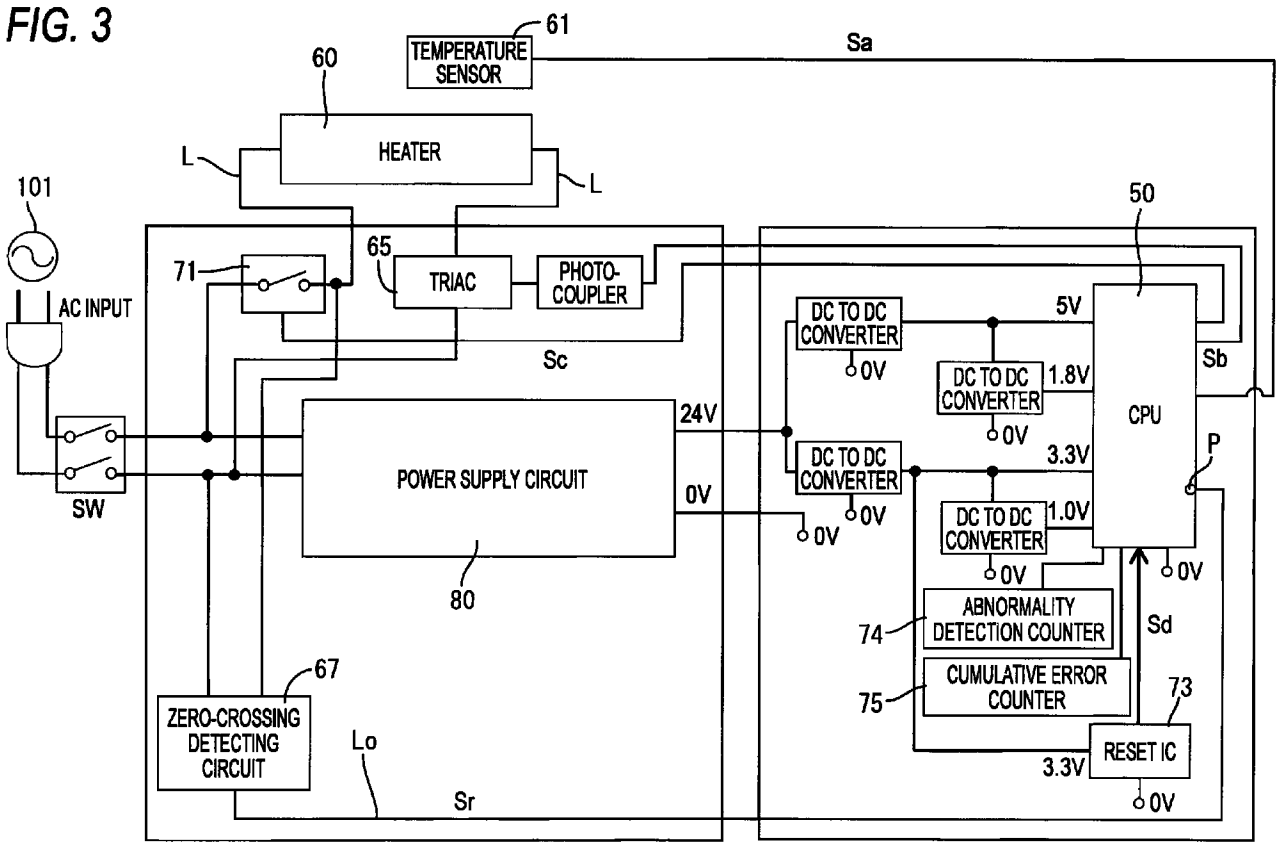
FIG. 3 is a block diagram illustrating a heating device.

FIG. 3 is a block diagram illustrating the configuration of the heating device 43. The heating device 43 includes a heater (an example of a heat generating unit of the present invention) 60, a temperature sensor 61, a TRIAC 65 which is an AC switch, a zero-crossing detecting circuit (an example of a zero-crossing signal generating unit of the present invention) 67, a relay 71, a power supply switch SW, the CPU 50, etc.

The heater 60 is a halogen lamp, is contained in the heating roller 41 such that the heater 60 extends in the center axis direction of the heating roller 41, and generates heat according to supply of electric power. The temperature sensor 61 includes a resistor, a thermistor, and so on (not shown). The thermistor is a resistive element whose electric resistance drastically changes according to a change in temperature, and is disposed in the vicinity of the heater 60. One end of the thermistor is grounded through the resistor, and the other end thereof is connected to a power supply line of 5V. The temperature sensor 61 uses the thermistor to output a temperature detection signal Sa according to the temperature of the heater to the CPU 50.

The TRIAC 65 is disposed on a power supply path L connecting an AC power supply 101 and the heater 60. The TRIAC 65 is turned on in response to a heater control signal Sb output from the CPU 50, and is turned off if an inverse voltage is applied or a current becomes 0. The TRIAC 65 supplies electric power to the heater 60 or interrupts the supply of electric power to the heater 60.

Like the TRIAC 65, the relay 71 is provided on the power supply path L. The relay 71 is for protecting the heater, and is turned off in response to an interruption signal Sc from the CPU 50, so as to interrupt the supply of electric power to the heater 60.

Figure 4:
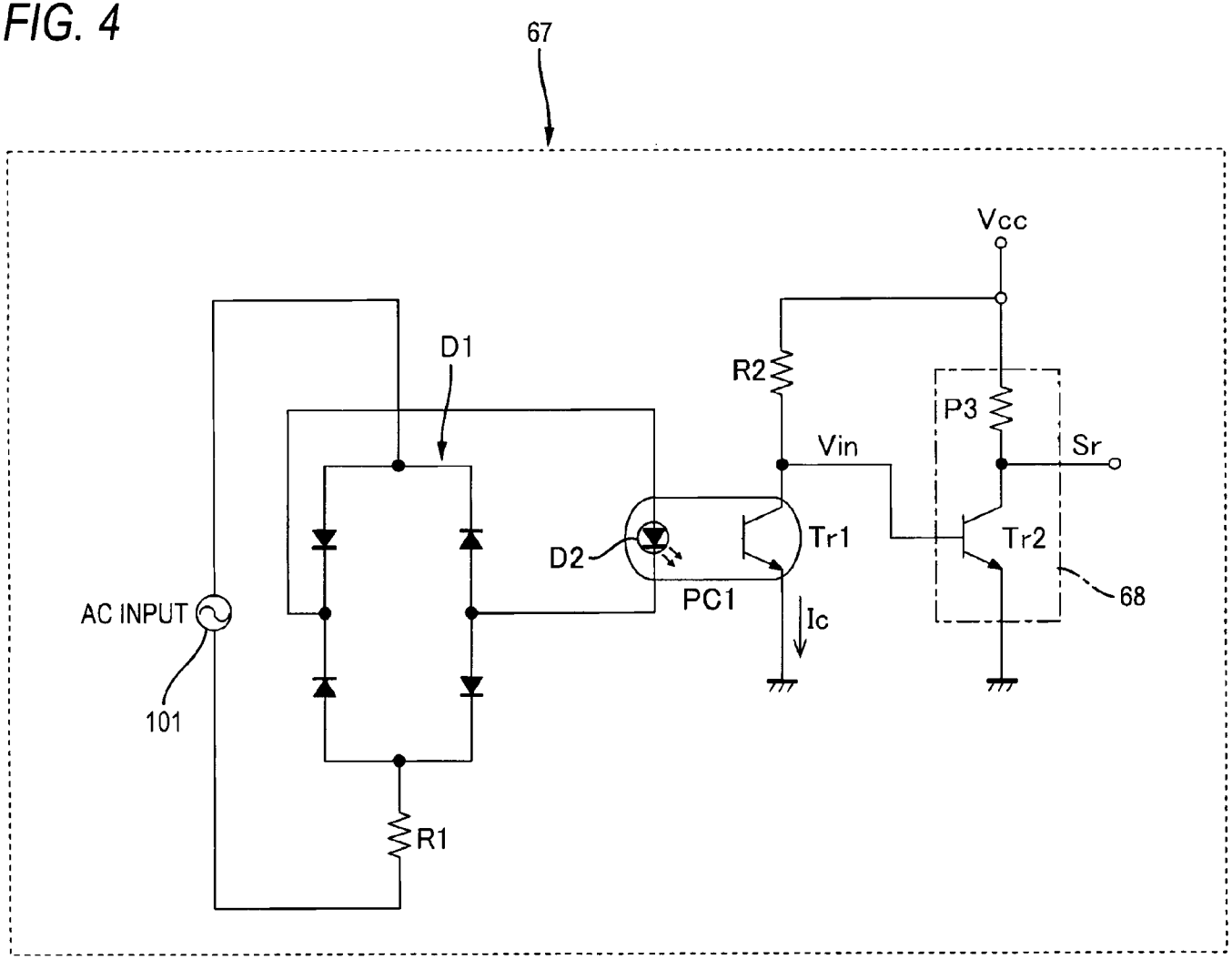
FIG. 4 is a circuit diagram of a zero-crossing detecting circuit.

The zero-crossing detecting circuit 67 outputs a square pulse zero-crossing signal Sr synchronized with zero-crossing timings of an AC voltage, and includes a resistor R1, a full-wave rectifier bridge circuit D1 that performs full-wave rectification of an output voltage V of the AC power supply 101, a light emitting diode D2 that is connected to the full-wave rectifier bridge circuit D1, a phototransistor TR1 that configures a photocoupler PC1 together with the light emitting diode D2, a resistor R2, and an inverter circuit 68, as shown in FIG. 4.

The emitter of the phototransistor TR1 is connected to the ground, and the collector thereof is connected to a DC power supply line Vcc through the resistor R2. Further, the inverter circuit 68 is connected to the collector of the photocoupler PC1 and inverts the (High/Low) voltage level of the collector and outputs the inverted voltage.

If the output voltage V of the AC power supply 101 decreases, an amount of luminescence of the light emitting diode D2 is reduced, and a current Ic flowing in the phototransistor TR1 decreases. Therefore, an input voltage Vin of the inverter circuit 68 increases. If the output voltage V of the AC power supply 101 is lower than a threshold value Vt, the output of the inverter circuit 68 becomes a low level.

Meanwhile, if the output voltage V of the AC power supply 101 increases, the amount of luminescence of the light emitting diode D2 increases, and the current Ic flowing in the phototransistor TR1 increases. Therefore, the input voltage Vin of the inverter circuit decreases. If the output voltage V of the AC power supply 101 exceeds the threshold value Vt, the output of the inverter circuit 68 becomes a high level.

Figure 5:
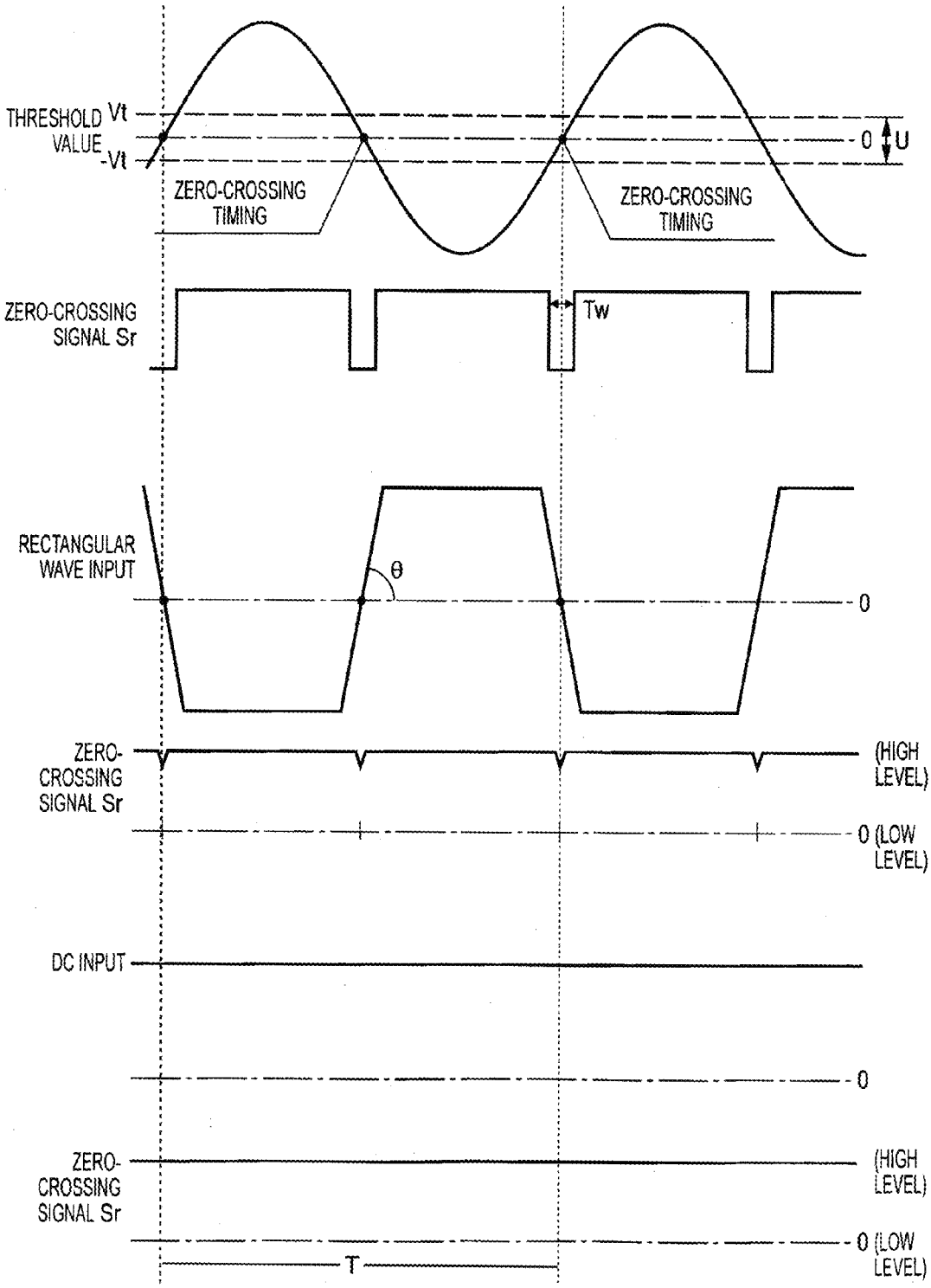
FIG. 5 is a view illustrating the waveforms of output voltages of power supplies and the waveforms of zero-crossing signals.

Therefore, as shown in FIG. 5, the zero-crossing detecting circuit 67 outputs a zero-crossing signal Sr having a pulse width Tw while the output voltage V of the AC power supply 101 is in a zero-crossing detection range defined by a positive threshold value Vt and a negative threshold value −Vt. More specifically, the zero-crossing detecting circuit 67 outputs a square pulse zero-crossing signal Sr whose signal level is the low level. Further, an output line Lo of the zero-crossing detecting circuit 67 is connected to an input port of the CPU 50 such that the CPU 50 can detect the zero-crossing signal Sr.

In the present exemplary embodiment, the inverter circuit 68 includes a common emitter transistor Tr2 and a resistor R3 connected to the collector of the transistor Tr2. However, the inverter circuit 68 can be replaced with an IC or the like, or can be omitted. In the present exemplary embodiment, since the zero-crossing detecting circuit 67 generates an active low output, the low level of the zero-crossing signal Sr corresponds to a first level of the present invention, and the high level of the zero-crossing signal Sr corresponds to a second level of the present invention.

The CPU 50 turns on and off the TRIAC 65 based on the temperature detection signal Sa output from the temperature sensor 61 and the zero-crossing signal Sr input to an input port P, thereby controlling an amount of power supply to the heater 60, such that the temperature of the heater 60 becomes a target temperature.

<Detection of Abnormality in Power Supply>

The heater receives electric power from the AC power supply 101, and the supply of electric power to the heater is controlled as described above. However, even though the power supply of the printer 1 should be a sine wave AC power supply of a commercial frequency, a DC power supply or an AC power supply for outputting a rectangular wave in which the rate of rise of voltage is fast may be connected to the printer 1.

If an AC power supply for outputting a rectangular wave in which the rate of rise of voltage is fast is connected, since a change in voltage in the vicinity of each zero-crossing is large, the TRIAC 65 may be continuously turned on such that it becomes impossible to control the amount of power supply to the heater 60. A fast rate of rise of voltage means a state where an angle θ of FIG. 5 is large and is close to 90 degrees. Even in a case where a DC power supply is connected, like when a rectangular wave is input, the TRIAC 65 may be continuously turned on such that it becomes impossible to control the amount of power supply.

For this reason, in the present exemplary embodiment, the CPU 50 detects an abnormality in the power supply, that is, whether a DC power supply or an AC power supply for outputting a rectangular wave in which the rate of rise of voltage is fast is connected to the printer 1.

In a case where a DC power supply is connected, the zero-crossing signal Sr is not output. Also, in a case where an AC power supply for outputting a rectangular wave in which the rate of rise of voltage is fast is connected, the pulse width Tw of the zero-crossing signal Sr may become narrower than a normal range, or the pulse width may further narrow such that the zero-crossing signal Sr is not output. For this reason, the CPU 50 detects the period (pulse period) and pulse width Tw of the zero-crossing signal Sr, and determines whether the period and pulse width Tw of the zero-crossing signal Sr are within normal ranges, thereby capable of detecting whether there is an abnormality in the power supply, that is, an abnormality in a frequency of the power supply during DC input or the like, or an abnormality in the output waveform of the power supply such as a rectangular wave input in which the rate of rise of voltage is fast.

However, in the case of detecting whether there is an abnormality in the power supply based on the period and pulse width Tw of the zero-crossing signal Sr, when the AC power supply is in the OFF state, it may be erroneously determined that there is an abnormality in the power supply.

This is because of the following reason. As shown in FIG. 3, the power supply system of the printer 1 is configured to supply electric power from the power supply circuit 80 to the CPU 50 through a DC-to-DC converter. Further, a reset IC 73 is provided to monitor the output voltage of the DC-to-DC converter. At the time when the output voltage of the DC-to-DC converter becomes lower than the operating voltage of the CPU 50, the reset IC 73 outputs an active low reset signal Sd to reset or stop the CPU 50.

Figure 6:
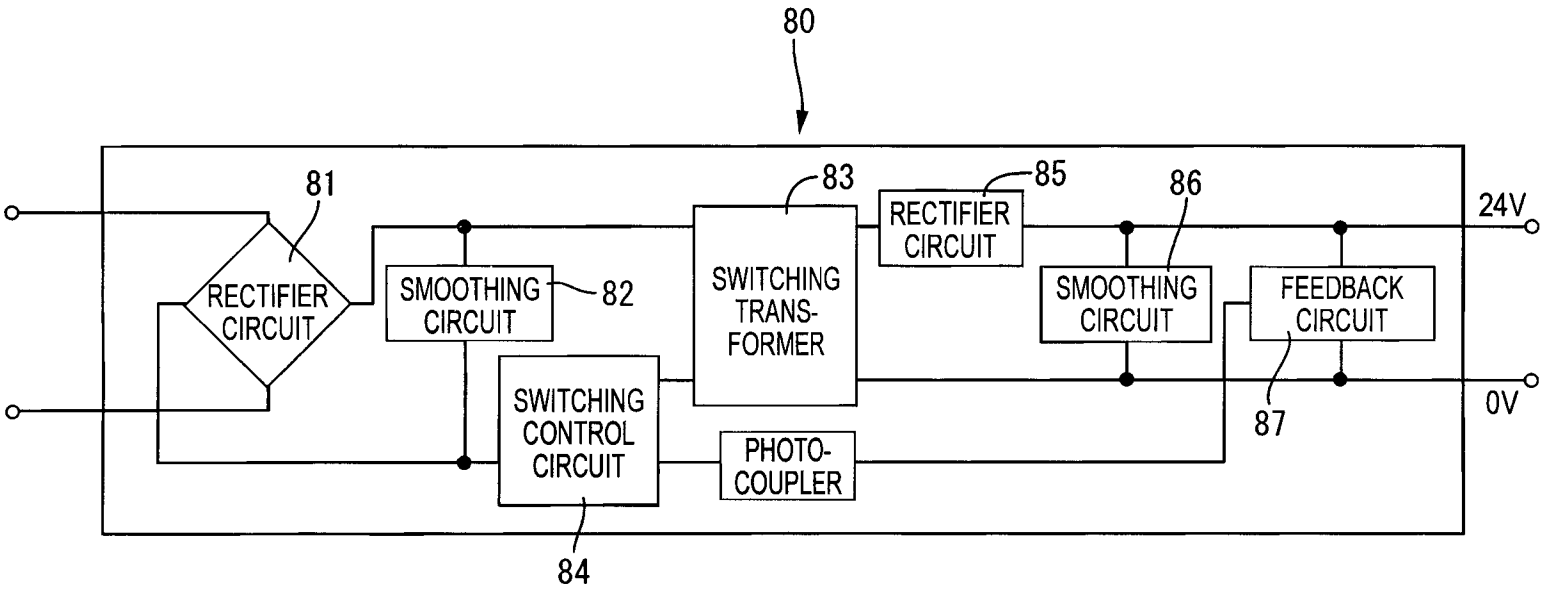
FIG. 6 is a block diagram illustrating a power supply circuit.

However, since the power supply circuit 80 includes a rectifier circuit 81, a smoothing circuit 82, a switching transformer 83, a switching control circuit 84, a rectifier circuit 85, a smoothing circuit 86, a feedback circuit 87, and so on, as shown in FIG. 6, even after the AC power supply is turned off, capacitors (not shown) configuring the smoothing circuits 82 and 86 are maintained in an electrically charged state for a predetermined time period.

Therefore, even if the power supply switch SW is turned off such that the AC power supply 101 is disconnected, during a period where there is electric charge remaining in the capacitors, the output voltage of the DC-to-DC converter is higher than the operating voltage of the CPU 50 and thus the reset signal Sd is not output.

For this reason, in a period from when the AC power supply is turned off to when the reset signal Sd is output (a period 'A' in FIG. 7), the CPU 50 is maintained at the operation state, and detects whether there is an abnormality in the power supply, based on the zero-crossing signal Sr.

Meanwhile, if the AC power supply is turned off, the zero-crossing signal Sr is not output from the zero-crossing detecting circuit 67 (the period of the zero-crossing signal Sr becomes a predetermined value or more). Therefore, it is feared that the CPU 50 will erroneously determine the state where the AC power supply is in the OFF state as an abnormality in the power supply, and perform error processing.

Figure 7:
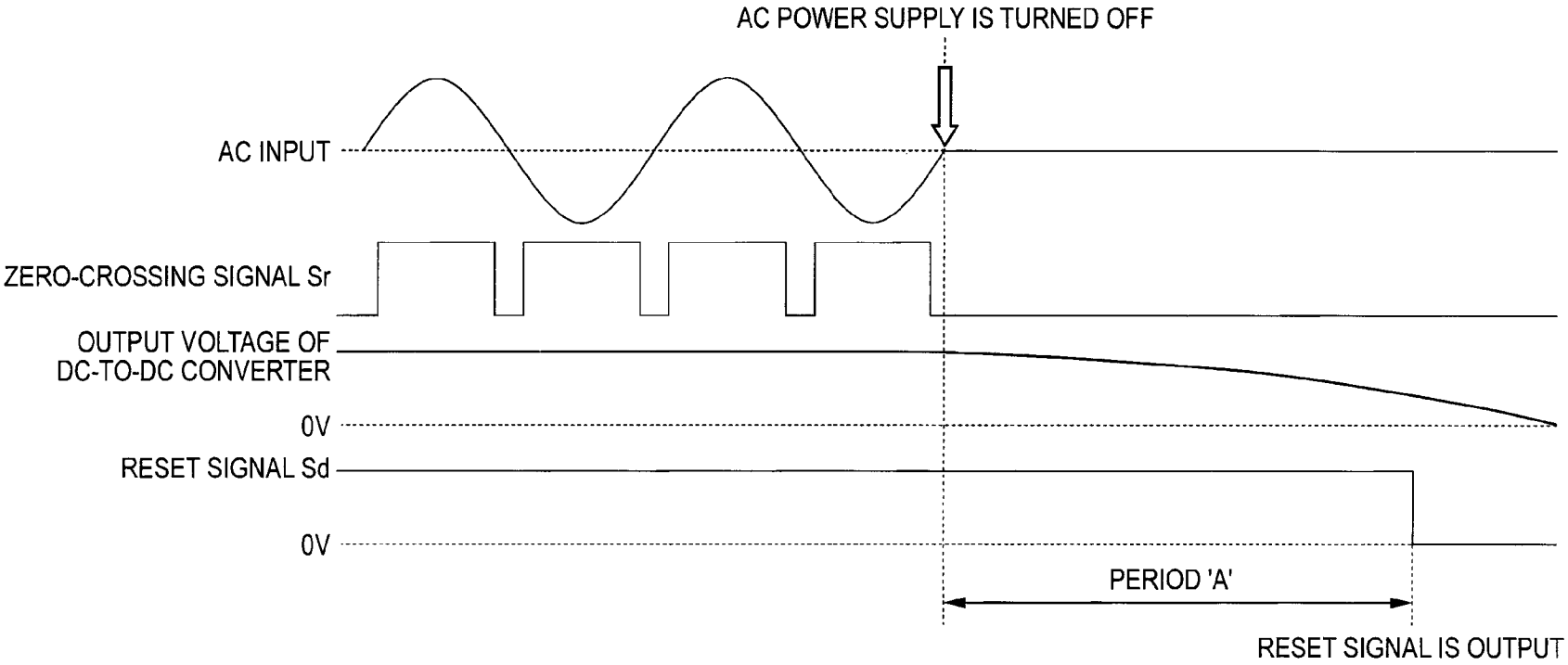
FIG. 7 is a view illustrating the waveform of the zero-crossing signal in a case where an AC power supply is turned off.

Here, during DC input, the zero-crossing signal Sr is at the high level as shown in FIG. 5. In contrast, when the AC power supply is in the OFF state, the zero-crossing signal Sr is at the low level as shown in FIG. 7.

For this reason, in the present exemplary embodiment, in a case where an abnormality is detected from the zero-crossing signal Sr, the CPU 50 determines whether the level of the zero-crossing signal Sr is the high level or the low level (a process of STEP S80 to be described below). In a case where the level of the zero-crossing signal Sr is the high level, the CPU 50 determines that the detected abnormality is an abnormality in the power supply, and performs error processing (processes of STEPS S100 to S140 to be described below). By doing so, it is possible to suppress the error processing from being erroneously performed when the AC power supply is in the OFF state.

<Sequence to Detect Abnormality in Power Supply>

Figure 8:
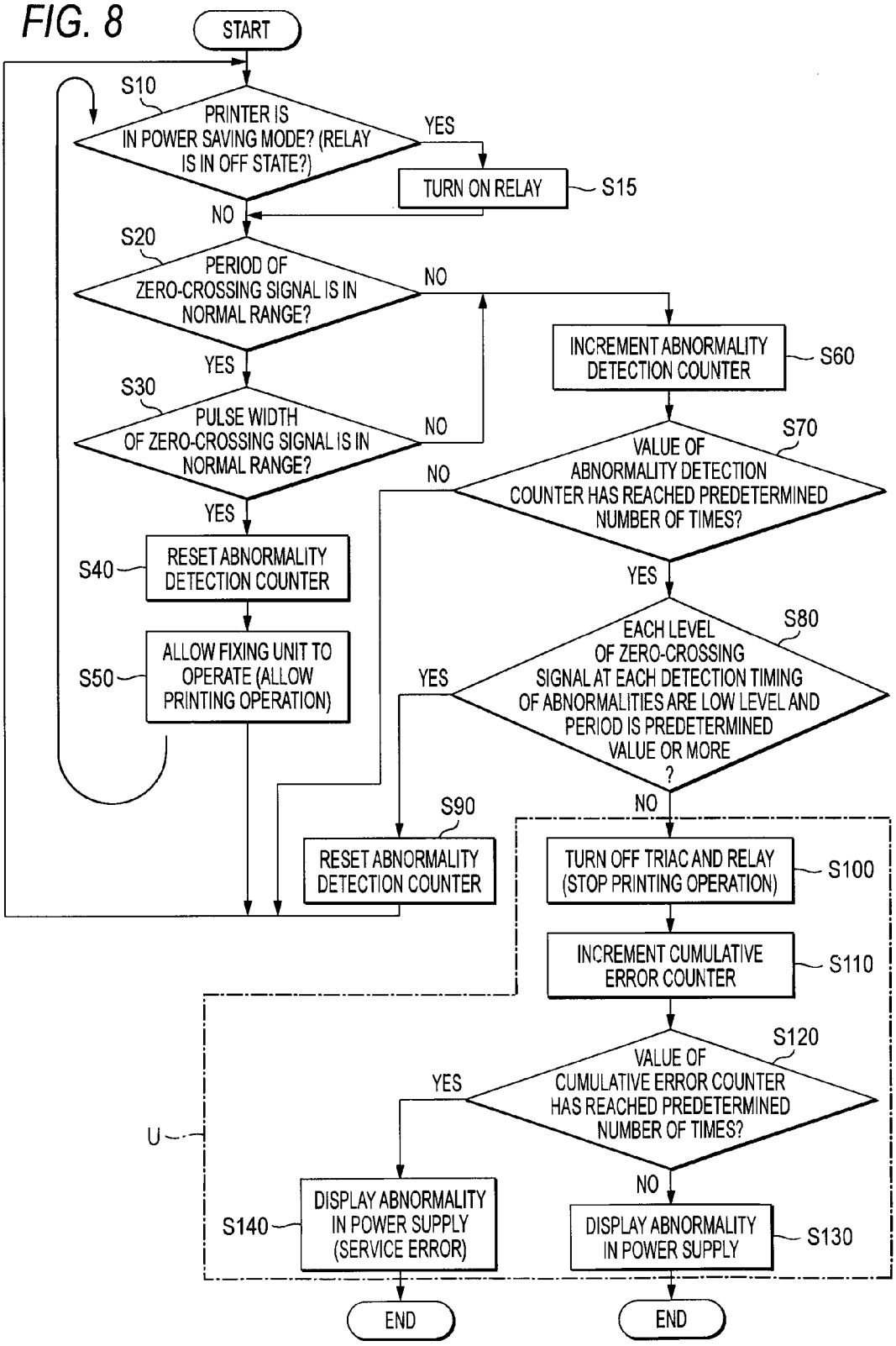
FIG. 8 is a flow chart illustrating a sequence to detect abnormalities in a power supply.

Hereinafter, a sequence which the CPU 50 of the control unit Z performs to detect an abnormality in the power supply will be described with reference to FIG. 8. It is assumed that the printer 1 has two modes, that is, a printing mode allowing supply of electric power to the heater 60 (a mode in which the relay 71 is in the ON state) and a power saving mode interrupting supply of electric power to the heater 60 (a mode in which the relay 71 is in the OFF state). Also, it is assumed that, in an initial state, an abnormality detection counter 74 and a cumulative error counter 75 are reset such that count values of them become 0.

If the power supply switch SW is turned on, the sequence to detect an abnormality in the power supply starts. First, in S10, the CPU 50 performs a process of determining whether the printer 1 is in the power saving mode. In a case where the printer 1 is in the printing mode, the determination result of S10 becomes 'NO'. In this case, the process proceeds to S20. Meanwhile, in a case where the printer 1 is in the power saving mode, the process proceeds to S15 in which the CPU 50 performs a process of turning on the relay 71, and proceeds to S20.

In S20, the CPU 50 performs a process of determining whether the period of the zero-crossing signal Sr is within the normal range. This process of S20 is for detecting an abnormality in the frequency of the power supply. In the present exemplary embodiment, the normal range of the period of the zero-crossing signal Sr is 5.97 mS (83.7 Hz) to 14.2 mS (35.3 Hz). If the period of the zero-crossing signal Sr is out of the normal range, the CPU 50 determines abnormality. In a case where it is not possible to detect the zero-crossing signal Sr, that is, a pulse, during a detection period (for example, 22 mS), the CPU 50 determines a timeout error.

Subsequently, in S30, similarly, the CPU 50 performs a process of determining whether the pulse width of the zero-crossing signal Sr is within a normal range. This process of S30 is a process of detecting mainly an abnormality in the output waveform of the power supply such as a fast rate of rise of voltage. In the present exemplary embodiment, the normal range of the pulse width is 10.67 μS to 10 mS. If the pulse width of the zero-crossing signal Sr is out of the normal range, the CPU 50 determines abnormality.

In a case where the sine wave AC power supply 101 of the commercial frequency is connected to the printer 1, the period of the zero-crossing signal Sr is in the normal range, and the pulse width is also in the normal range. Therefore, the determination results of both of S20 and S30 are 'YES'. In this case, the process proceeds to S40.

In S40, the CPU 50 performs a process of resetting the abnormality detection counter 74. The abnormality detection counter 74 counts the number of times the determination result of S20 or S30 is 'NO', that is, the number of times an abnormality in the power supply is detected.

Thereafter, the process proceeds to S50. In S50, the CPU 50 performs a process of allowing the fixing unit to operate or allowing a printing operation. Then, the process returns to S10. If the sine wave AC power supply 101 of the commercial frequency is connected to the printer 1, the determination results of both of S20 and S30 become 'YES'. Therefore, the sequence to detect an abnormality in the power supply repeats the processes of S10 to S50. During this period, if receiving a print instruction, the CPU 50 performs a process of supplying electric power to the heater 60 and operating the fixing unit 18 to thermally fix a toner image onto a printing sheet 3.

Meanwhile, in a case where the DC power supply is connected to the printer 1, the zero-crossing signal Sr is always at the high level as shown in the bottom section of FIG. 5, and thus a pulse is not output. Therefore, in the determining process of S20, the CPU 50 determines that there is a timeout error, and thus the determination result becomes 'NO'.

If the determination result of S20 is 'NO', the process proceeds to S60. In S60, the CPU 50 performs a process of incrementing the abnormality detection counter 74, that is, a counting process. Thereafter, the process proceeds to S70 in which the CPU 50 performs a process of determining whether the abnormality detection counter 74 has reached a predetermined number of times (for example, 42 times). In a case where the abnormality detection counter 74 has not reached the predetermined number of times, the determination result of S70 becomes 'NO', and thus the process returns to S10. In the present exemplary embodiment, an example in which the abnormality detection counter 74 and the cumulative error counter 75 are provided separately from the CPU 50 is shown. However, on-chip registers of the CPU 50 may be used to configure the abnormality detection counter 74 and the cumulative error counter 75.

In the case where the DC power supply is connected to the printer 1, as described above, the zero-crossing signal Sr is always at the high level, such that a pulse is not output. For this reason, in S20, a timeout error is always determined, and the determination result repeatedly becomes 'NO'. Therefore, the count value of the abnormality detection counter 74 reaches the predetermined number of times, and thus the determination result of S70 becomes 'NO'.

In a case where the determination result of S70 is 'YES', the process proceeds to S80. In S80, the CPU 50 performs a process of determining the level of the zero-crossing signal Sr at the abnormality detection timings and a process of determining the period of the zero-crossing signal Sr. In a case where, the level of the zero-crossing signal Sr is the low level at all abnormality detection timings and the period of the zero-crossing signal is a predetermined value (a period longer than at least the normal range of the period) or more, the determination result of S80 becomes 'YES', and in other cases, the determination result of S80 becomes 'NO'.

An abnormality detection timing means the determination timing of S20 or S30 (the timing when the determination result becomes 'NO'). In the case where the DC power supply is connected, since the determination result of S20 becomes 'NO' due to a timeout error, the detection timing of the timeout error becomes an abnormality detection timing In order to determine the period of the zero-crossing signal Sr, for example, a period counter (not shown) for counting the period of the zero-crossing signal Sr may be provided. In this case, the count value of the period counter is compared to a predetermined upper limit value, and if the count value is equal to the upper limit value, it is determined that the period of the zero-crossing signal Sr is the predetermined value or more.

In the case where the DC power supply is connected to the printer 1, as shown in FIG. 5, the zero-crossing signal Sr is always at the high level without pulse output. Therefore, at all timeout error detection timings, the level of the zero-crossing signal Sr is the high level, and the period becomes the predetermined value or more. As a result, the determination result of S80 becomes 'NO'. If the determination result of S80 is 'NO', error processing U of S100 to S140 is performed. First, in S100, the CPU 50 performs a process of turning off the TRIAC 65 and the relay 71. As a result, the supply of electric power to the heater 60 is interrupted.

Sequentially, in S110, the CPU 50 performs a process of incrementing the cumulative error counter 75, that is, a counting process. The cumulative error count value is written in the EEPROM 53. Therefore, even if the AC power supply 101 is turned off, the count value is not reset.

Subsequently, in S120, the CPU 50 performs a process of determining whether the cumulative error counter 75 has reached a predetermined number of times (for example, 100 times). In a case where the cumulative error count value is less than the predetermined number of times, the determination result of 5120 becomes 'NO', and the process proceeds to S130. In 5130, the CPU 50 performs a process of displaying the abnormality in the power supply on the display unit 54.

In a case where the cumulative error counter 75 has not reached the predetermined number of times, error processing is performed as described above. In this case, if the power supply 101 is connected again, the printer 1 recovers from the error state, such that the supply of electric power to the heater 60 is possible.

Meanwhile, in a case where the cumulative error count value is the predetermined number of times or more, the determination result of S120 becomes 'YES', and the process proceeds to S140. In S140, the CPU 50 performs a process of displaying a service error on the display unit 54. The service error is written in the EEPROM 53, such that even if the power supply 101 is connected again, the data on the service error remains. Therefore, even if the power supply is connected again, the printer 1 becomes a state where supply of electric power to the heater 60 is prohibited, without recovering from the error state. Further, the service error is displayed on the display unit 54 again. The service error can be removed only by a service center.

Not only in the case where the DC power supply is connected but also in the case where the AC power supply for outputting a rectangular wave in which the rate of rise of voltage is fast is connected, as shown in the middle section of FIG. 5, the zero-crossing signal Sr may be held at the high level, without pulse output. In this case, similar to the case where the DC power supply is connected, in S20, the determination result becomes 'NO' 42 times due to timeout errors, and the process proceeds to S80. The determination result of S80 becomes 'NO', and the process proceeds to S100 in which the CPU 50 performs the error processing U of S100 to S140, like in the case where the DC power supply is connected.

Next, the case where the power supply switch SW of the printer 1 is turned off, that is, the case where the AC power supply is turned off will be described. If the AC power supply 101 is turned off, as shown in FIG. 7, the zero-crossing signal Sr is held at the low level, without pulse output. Therefore, in the determining process of S20, it is determined that there is a timeout error. As a result, the determination result of S20 becomes 'NO'. Then, the process proceeds to S60.

In S60, like in the case where the DC power supply is connected or the case where the AC power supply for outputting a rectangular wave in which the rate of rise of voltage is fast is connected, the CPU 50 performs the process of incrementing the abnormality detection counter 74, that is, the counting process. Subsequently, the process proceeds to S70 in which the CPU 50 performs a process of determining whether the abnormality detection counter 74 has reached the predetermined number of times (for example, 42 times). In a case where the abnormality detection counter 74 has not reached the predetermined number of times, the determination result of S70 becomes 'NO', and thus the process returns to S10.

In a period from when the AC power supply is turned off to when the reset signal Sd is output, the processes of S10, S20, S60 and S70 of the sequence to detect an abnormality in the power supply are repeated. Therefore, the count value of the abnormality detection counter 74 is incremented as time goes on, and finally reaches the predetermined number of times.

If the count value of the abnormality detection counter 74 reaches the predetermined number of times, the determination result of S70 becomes 'YES', and the process proceeds to S80. In S80, the CPU 50 performs a process of determining the level and period of the zero-crossing signal Sr at the time of abnormality detection.

In the case where the AC power supply is turned off, as shown in FIG. 7, the zero-crossing signal Sr is always at the low level, without pulse output. Therefore, at all timeout error detection timings, the level of the zero-crossing signal Sr is the low level, and the period is the predetermined value or more. As a result, the determination result of S80 becomes 'YES'. In this case, the process proceeds to S90 in which the CPU 50 performs the process of resetting the abnormality detection counter 74.

As described above, in the case where the AC power supply is in the OFF state, even if the abnormality detection counter 74 reaches the predetermined number of times, the determination result of S80 becomes 'YES'. Therefore, the error processing U of S100 to 5140 is not performed. Therefore, it is possible to suppress the error processing from being erroneously performed when the AC power supply is in the OFF state.

In the present exemplary embodiment, since the predetermined number of times (for example, 42 times) is provided for the number of times of abnormality detection, even if there is an abnormality in the period of the zero-crossing signal Sr in the S20, or there is an abnormality in the pulse width Tw of the zero-crossing signal Sr in S30, in a case where the number of times of abnormality detection is smaller than the predetermined number of times, it is determined that there is no abnormality in the power supply. Therefore, it is possible to suppress erroneous detection due to noise and the like.

Also, in the present exemplary embodiment, in the determining process of S80, in addition to the determination the level of the zero-crossing signal Sr, the determination of the period is performed, and only when the level of the zero-crossing signal Sr is the low level at all abnormality detection timings and the period is the predetermined value or more, the error processing is not performed. In other words, even if the level of the zero-crossing signal Sr is the low level at all abnormality detection timings, if the period is less than the predetermined value, the error processing is performed.

Accordingly, the following effects are achieved. For example, in the case where the AC power supply for outputting a rectangular wave in which the rate of rise of voltage is fast is connected to the printer 1, other than the case where the pulse width of the zero-crossing signal becomes extremely narrow and there is no pulse output, there is a case where pulse is output but the pulse width is out of the normal range, such that the determination result of S30 becomes 'NO'.

In this case, at all abnormality detection timings, the zero-crossing signal Sr is at the low level. Therefore, if only the level of the zero-crossing signal Sr is determined in S80, like in the case where the power supply is in the OFF state, the determination result of S80 becomes 'YES', and thus the error processing U is not performed. However, in the present exemplary embodiment, the determination condition of S80 includes whether the period is the predetermined value or more. Therefore, in the above-mentioned sequence, since it is determined that the period is less than the predetermined value, it is possible to correctly perform the determination (the determination result of S80 is 'NO') and to surely perform the error processing U of S100 to S140.

Also, in the present exemplary embodiment, if the number of times of abnormality detection exceeds the predetermined number of times, the process of determining the level and period of the zero-crossing signal Sr (the process of S80) is performed collectively. Therefore, it is possible to more efficiently perform the determining process, as compared to a case of determining the level and period of the zero-crossing signal Sr whenever an abnormality is detected.

Further, in the present exemplary embodiment, if the determination result of S80 is 'NO', the process proceeds to the error processing U in which supply of electric power to the heater 60 is prohibited in S 100. Therefore, it is possible to prevent abnormal supply of electric power to the heater 60 due to an abnormality in the power supply, and to suppress deterioration of the heater 60.

Furthermore, in the present exemplary embodiment, whether the frequency of the power supply or the output waveform of the power supply is abnormal is determined according to whether the period and pulse width Tw of the zero-crossing signal Sr are within the normal ranges. Therefore, it is unnecessary to separately provide a detecting unit for detecting an abnormality in the frequency of the power supply or the output waveform, and thus it is possible to simplify the apparatus.

<Other Exemplary Embodiments>

The present invention is not limited to the exemplary embodiment explained by the above-mentioned description and the drawings. For example, the following embodiments can also be included in the technical scope of the present invention.

(1) In the above-mentioned embodiment, an abnormality in the frequency of the power supply is detected based on the period of the zero-crossing signal Sr, and an abnormality in the output waveform, such as output of a rectangular wave, is detected based on the pulse width of the zero-crossing signal Sr. However, the detection of an abnormality in the frequency of the power supply or an abnormality in the output waveform can be performed not only by the method of performing the detection based on the zero-crossing signal Sr, but also by directly sampling the voltage waveform of the power supply and detecting the frequency or the rate of change of the voltage at each zero-crossing.

(2) In the above-mentioned embodiment, as the case where the frequency of the power supply is abnormal, DC input has been exemplified. However, for example, not only complete DC but also AC input which has a very long period and thus is generally considered as DC may be detected as abnormalities.

(3) In the above-mentioned embodiment, as the zero-crossing signal Sr, the active low type signal has been exemplified. However, the zero-crossing signal Sr needs only to be a pulse-like signal synchronized with the zero-crossings of the output voltage V of the AC power supply 101, and thus may be an active high type signal. In this case, contrary to the example of the embodiment, the first level becomes the high level, and the second level becomes the low level.

(4) In the above-mentioned embodiment, in the determining process of S80, the level and period of the zero-crossing signal Sr is determined. In the case where the zero-crossing signals Sr is at the low level at all abnormality detection timings and the period is the predetermined value or more, the determination result becomes 'YES' and the abnormality detection counter is reset (in this case, the error processing is not performed). In other cases, the determination result becomes 'NO' and the error processing of S100 to S140 is performed. Here, the determination of the period is performed so as to prevent the determination result of S80 from becoming 'YES' in the case where the determination result of S30 is 'NO' and the process proceeds to S80. If the determining process of S30 is separated as another flow, the determination of the period in S80 can be omitted and is not necessarily required. In other words, in a case where only the determining process of S20 is performed before S80, in the determining process of S80, only the level of the zero-crossing signal Sr may be determined In this case, if the zero-crossing signal Sr is at the low level at all abnormality detection timings, the determination result of S80 may become 'YES', and the abnormality detection counter may be reset, and in other cases, the error processing of S100 to S140 may be performed.

The present invention provides illustrative, non-limiting aspects as follows:

(1) According to a first aspect, there is provided a heating device including: a heat generating unit configured to generate heat in response to receiving an AC voltage from a power supply; a zero-crossing signal generating unit configured to generate a zero-crossing signal which is a square pulse signal synchronizing with a zero-crossing timing of the AC voltage supplied from the power supply and received by the heat generating unit, the zero-crossing signal being a first level at the zero-crossing timing and being a second level at other timings; and a control device configured to perform a detecting process in which an abnormality in a frequency of the power supply or an abnormality in an output waveform of the power supply is detected, and an error processing, in a case where the abnormality in the frequency of the power supply or the abnormality in the output waveform of the power supply is detected and the level of a zero-crossing signal at a detection timing of detecting the abnormality is the second level.

(2) According to a second aspect, there is provided the heating device according to the first aspect, wherein in a case where the number of times that the abnormality has been detected with respect to the frequency or the output waveform of the power supply is a predetermined number of times or more, the control device determines whether the level of the zero-crossing signal at the detection timing is the second level, and if it is determined that the level of the zero-crossing signal is the second level, the control device performs the error processing.

(3) According to the third aspect, there is provided the heating device according to the first or second aspect, wherein the control device prohibits supply of electric power to the heat generating unit as the error processing.

(4) According to a fourth aspect, there is provided the heating device according to any one of the first to third aspects, wherein in a case where a period of the zero-crossing signal is out of a normal range, the control device determines that there is an abnormality in the frequency of the power supply.

(5) According to a fifth aspect, there is provide the heating device according to any one of the first to third aspects, wherein in a case where a pulse width of the zero-crossing signal is out of a normal range, the control device determines that there is an abnormality in the output waveform of the power supply.

(6) According to the sixth aspect, there is provided the heating device according to the fifth aspect, wherein in a case where each level of the zero-crossing signal at each detection timing is the first level and a period of the zero-crossing signal is a predetermined value or more, the control device does not perform the error processing, and in other cases, the control device performs the error processing.

(7) According to the seventh aspect, there is provided an image forming apparatus including: an image forming unit configured to form a toner image on a recording medium; and the heating device according to any one of the first to sixth aspects configured to fix the toner image formed by the image forming unit to the recording medium.

(8) According to an eighth aspect, there is provided a heating device including: a heat generating unit configured to generate heat in response to receiving an AC voltage from a power supply; a zero-crossing signal generating unit configured to generate a zero-crossing signal which is a square pulse signal synchronizing with a zero-crossing timing of the AC voltage supplied from the power supply and received by the heat generating unit, the zero-crossing signal being a first level at the zero-crossing timing and being a second level at other timings; and a control device configured to obtain a period of the zero-cross signal, determine a first abnormality if the obtained period does not satisfy a first condition, obtain a pulse width of the zero-cross-signal, when the first abnormality is not determined, determine a second abnormality if the obtained pulse width does not satisfy a second condition, and perform error processing when the first abnormality is determined and the level of a zero-crossing signal at a detection timing of determining the first abnormality is the second level or when the second abnormality is determined and the level of a zero-crossing signal at the detection timing of determining the second abnormality is the second level.

(9) According to the ninth aspect, there is provided the heating device according to the eighth aspect, wherein the control device prohibits supply of electric power to the heat generating unit as the error processing.

(10) According to the tenth aspect, there is provided the heating device according to the eighth aspect, wherein the first condition is satisfied when the obtained period of the zero-crossing signal is out of a normal range.

(11) According to the eleventh aspect, there is provided the heating device according to the eighth aspect, wherein the second condition is satisfied when the obtained pulse width of the zero-crossing signal is out of a normal range.

What is claimed is:

1. A heating device comprising:

a heat generating unit configured to generate heat in response to receiving an AC voltage from a power supply;

a signal generating unit configured to generate:

a zero-crossing signal of a first level, at a zero crossing timing in which an absolute value of the voltage received from the power supply is equal to or smaller than a threshold value, and a signal of a second level which is different from the first level, at a timing in which the absolute value of the voltage received from the power supply is larger than the threshold value; and a control device configured to obtain a period of the zero-crossing signal, determine a first abnormality if the obtained period does not satisfy a predetermined condition, or the zero-crossing signal is not detected during a predetermined time period, obtain a pulse width of the zero-crossing-signal, when the first abnormality is not determined, determine a second abnormality if the obtained pulse width is narrower than a normal range, and perform error processing when the first abnormality is determined and the level of the signal at a detection timing of determining the first abnormality is the second level or when the second abnormality is determined and the level of the signal at the detection timing of determining the second abnormality is the first level.

2. The heating device according to claim 1, wherein the control device prohibits supply of electric power to the heat generating unit as the error processing.

3. The heating device according to claim 1, wherein the predetermined condition is satisfied when the obtained period of the zero-crossing signal is within a normal range.

4. The heating device according to claim 1, wherein the control device is further configured to:

count a number of times that the first abnormality or the second abnormality is determined, and perform the error processing if the counted number of times is a predetermined number of times or larger.

5. The heating device according to claim 4, wherein the control device is further configured to:

reset the counted number of times if the obtained pulse width is not narrower than the normal range.

6. An image forming apparatus comprising:

an image forming unit configured to form a toner image on a recording medium; and the heating device according to claim 1 configured to fix the toner image formed by the image forming unit to the recording medium.

* * * * *